United States Patent [19]

Weil

[11] Patent Number: 4,819,899

[45] Date of Patent: Apr. 11, 1989

[54] MERCHANDISING RACK

[75] Inventor: Geoffrey L. Weil, Florence, S.C.

[73] Assignee: Sonoco Products Company, Hartsville, S.C.

[21] Appl. No.: 168,072

[22] Filed: Mar. 14, 1988

[51] Int. Cl.[4] ..... A63B 55/04

[52] U.S. Cl. ..... 248/97; 211/133; 211/181; 248/175

[58] Field of Search ..... 248/97, 98, 95, 175; 211/181, 133, 106

[56] References Cited

U.S. PATENT DOCUMENTS

| | | | |
|---|---|---|---|
| D. 93,944 | 11/1934 | Schimmelfeng . | |
| D. 238,649 | 2/1976 | Martin . | |
| 3,704,791 | 12/1972 | Young, Jr. | 211/181 X |
| 3,747,298 | 7/1973 | Lieberman . | |
| 4,106,733 | 8/1978 | Walitalo . | |
| 4,189,056 | 2/1980 | Majewski | 211/181 X |
| 4,694,966 | 9/1987 | Sorenson et al. | 211/181 X |
| 4,723,743 | 2/1988 | Jenkins | 248/97 |

*Primary Examiner*—Ramon O. Ramirez

*Attorney, Agent, or Firm*—Dennison, Meserole, Pollack & Scheiner

[57] ABSTRACT

A merchandising rack comprising a support wall affixed to a planar base. A pair of bag-support arms overlie the base in upwardly spaced relation thereto. A pair of side arms extend laterally from the support wall intermediate the bag-support arms and the base, and include retainers for engagement of bag handles thereover. A pair of trays extend to the opposite side of the support wall from the base and are interconnected by a vertical rear support which is engaged with and supported by the vertical support wall by upper and lower stand-off brackets. The vertical support mounts a display panel transversely across the upper end thereof. The opposed ends of the trays are interconnected by side legs which terminate in lower support feet.

11 Claims, 2 Drawing Sheets

MERCHANDISING RACK

BACKGROUND OF THE INVENTION

Checkout counters at grocery stores and like establishments have increasingly taken on functions other than receiving the customers' goods for tallying and packaging by the checker.

For example, it is now common for a portion of the checkout counter to have merchandise displaying and dispensing stands positioned thereon or immediately adjacent thereto, to attract the attention and buying interest of the customer. In addition, with the advent of plastic grocery bags, it is not unusual to encounter specifically designed bag storing and dispensing stands also on the checkout counter.

Examples of bag storing and dispensing stands will be noted in the following patents:

Pinto, U.S. Pat. No. 3,552,697, Jan. 5, 1971
Lieberman, U.S. Pat. No. 3,747,298, July 24, 1973
Provan, U.S. Pat. No. 4,487,388, Dec. 11, 1984

SUMMARY OF THE INVENTION

The present invention is directed to a merchandising assembly or rack which compactly, and in a single unit, stores both goods for display and sale, and bags for individual dispensing and the packaging of goods therein.

The merchandising rack is free standing and portable, easily repositioned on the checkout counter as desired. Similary, the rack can easily be shifted from one counter to another with both goods and bags stored thereon. thus, there is no necessity, as now commonly occurs, to maintain individual loaded racks on or adjacent checkout counters which are not being used. To the contrary, to open a close checkout counter, one need merely place thereon a single merchandising rack in accord with the present invention which will normally be maintained fully stocked with both goods and bags.

The unitary merchandising rack comprises a central vertical support wall affixed to a horizontally directed planar base. A pair of laterally spaced parallel bag-support arms overlie the base in upwardly spaced relation thereto. A pair of side arms similarly extend laterally from the support wall intermediate the bag-support arms and the base, and incorporate hook-like retainers for the selective engagement of loop bag handles thereover.

A pair of trays extend to the opposite side of the support wall from the base and are interconnected by a vertical rear support which is in turn engaged with and supported by the vertical support wall by means of upper and lower stand-off brackets. The vertical support mounts a display panel transversely across the upper end thereof with the display panel defining a handgrip for carrying the merchandising rack.

The opposed ends of the vertically aligned trays are interconnected by side legs which terminate in lower support feet.

Other features and objects of the invention will be noted from the details of the invention as more fully hereinafter described and claimed.

DESCRIPTION OF PREFERRED EMBODIMENT

Figure 1:
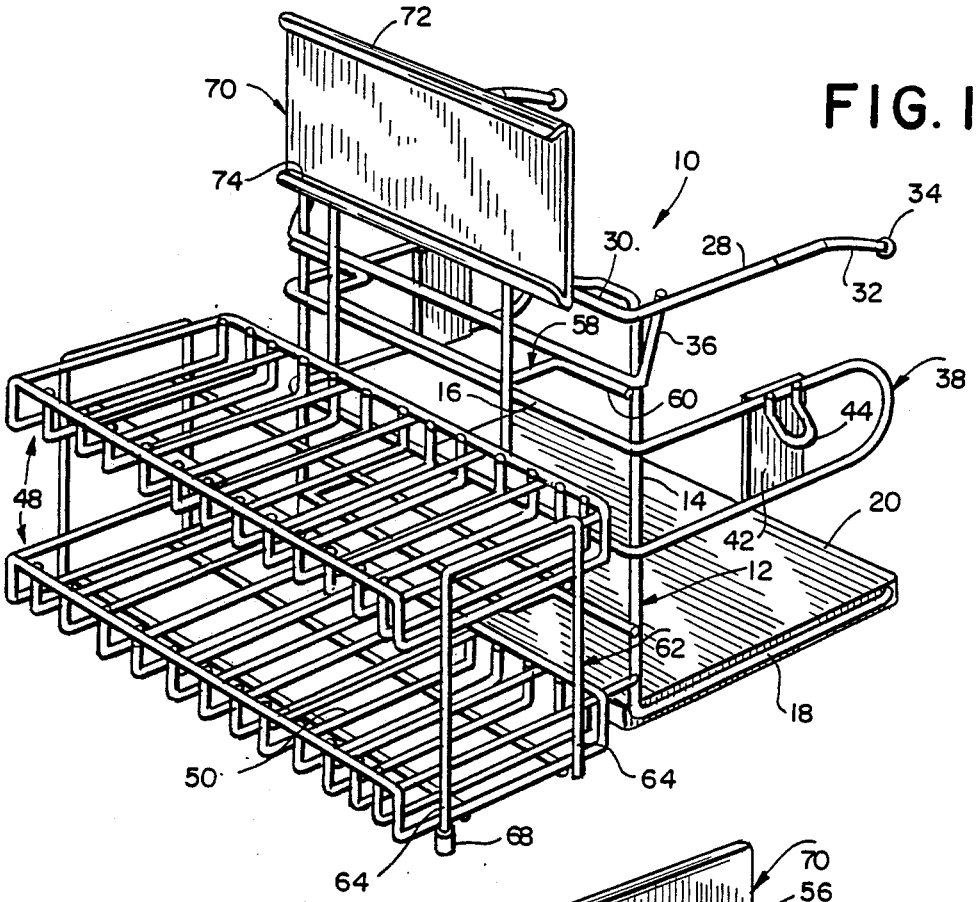
FIG. 1 is a perspective view from one side of the merchandising rack of the invention.
Figure 2:
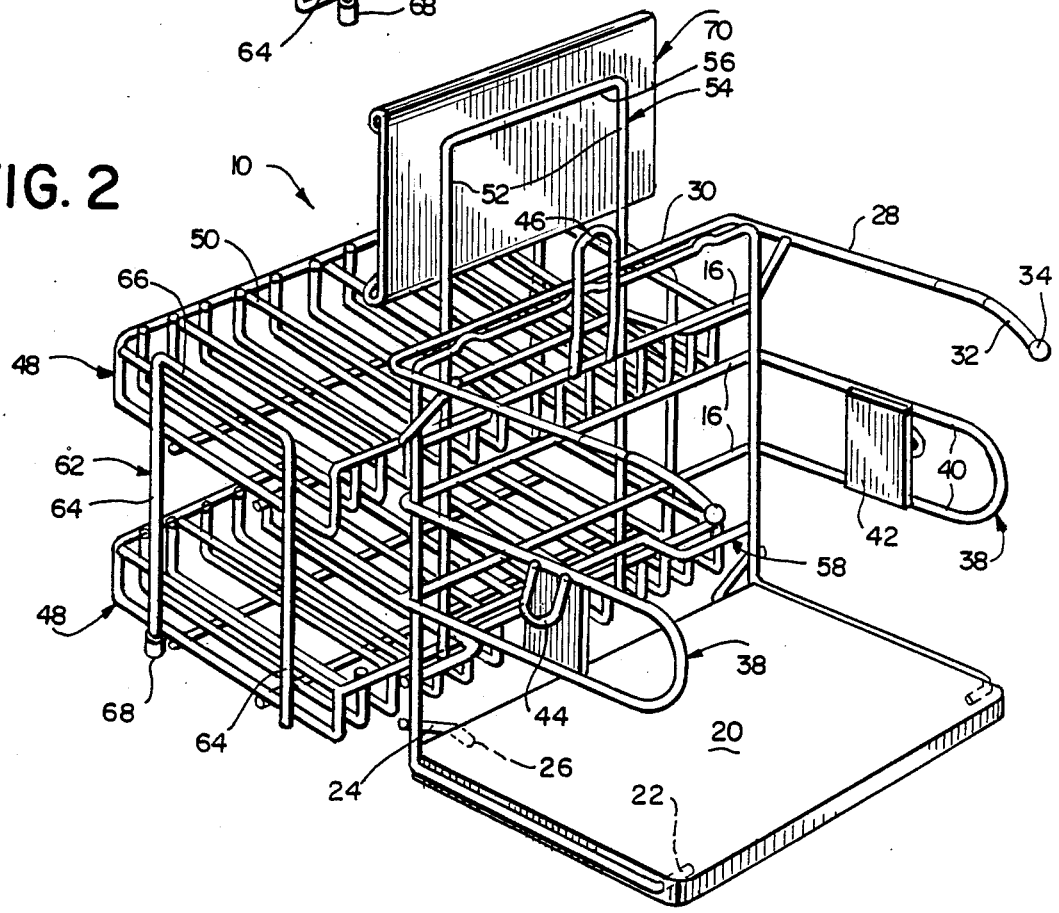
FIG. 2 is a perspective view from an opposite side thereof.
Figure 3:
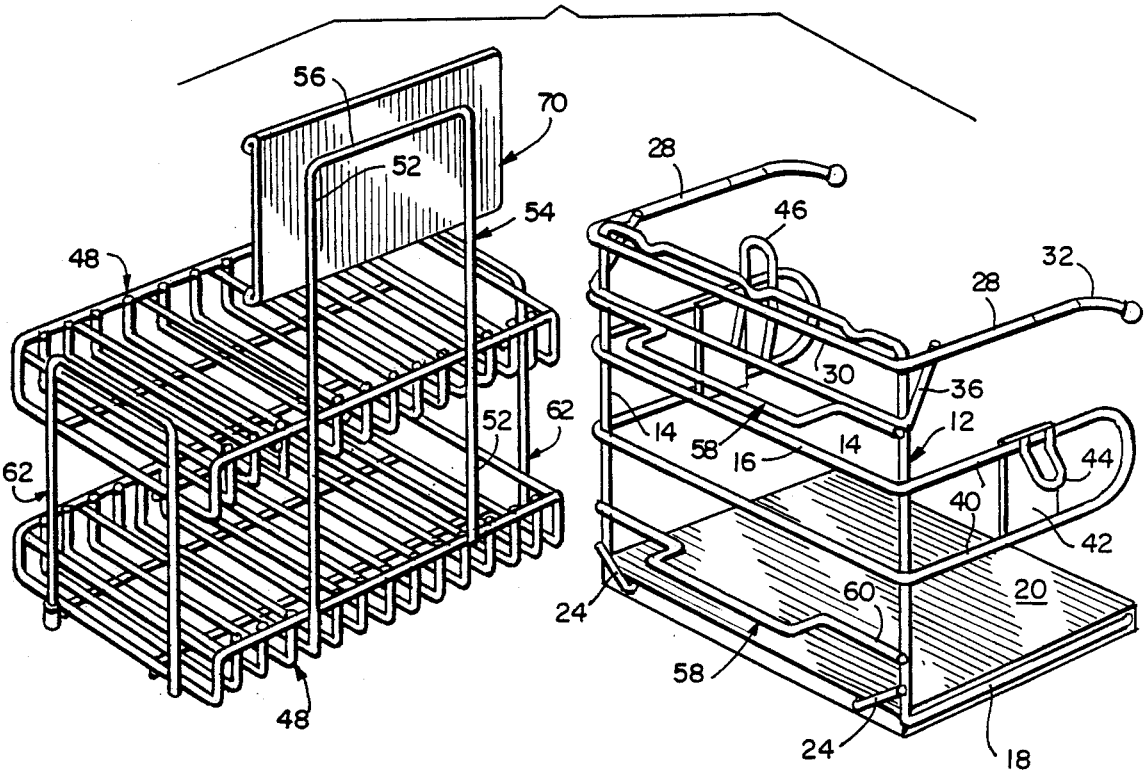
FIG. 3 is a perspective view of the merchandising rack with portions thereof exploded for purposes of illustration.

Referring now more specifically to the drawings, the merchandising rack 10 includes a central vertical support wall 12. The support wall 12 is preferably in the nature of a rigid open framework including vertical side standards 14 and transverse cross bars 16.

Horizontally directed base bars 18 are integrally formed with the lower ends of the standards 14 and extend outwardly therefrom in laterally spaced parallel relation to each other. A horizontal planar supporting base 20 is positioned between the base bars 18. The base bars 18 in turn lock to the base 20 through inwardly directed terminal base bar ends 22 which engage within corresponding bores in the base 20 toward the outer ends of the base sides against which the side bars 18 engage. The base bars 18 may include a degree of inherent resilient flexibility to facilitate engagement of the ends 22 thereof within the respective base bars.

The rear portion of base 20 is similarly locked to the support framework by a pair of rod braces 24 having inturned ends 26 engaged within corresponding bores along the rear edge of the base 20. The opposite ends of the braces 24 are welded to the support wall standards 14 in spaced relation above the base 20.

The base 20, in addition to comprising the supporting base for the entire rack, also forms a support surface for a bag within which goods are to be packaged. In order to support an open bag, the rack can include a pair of laterally spaced horizontally extending elongate support arms 28 integrally formed with a cross rod 30 paralleling and welded to the uppermost cross bar 16. The arms 28 parallel the opposed sides of the base 20 at a height sufficient to support a bag fully opened with the bottom of the bag on the support surface of the base 20. The arms 28, in a known manner, are received through apertures in the upper portions of the bag. The outer ends of the arms 28, for convenience in removing a loaded bag and positioning a subsequent bag, are provided with flexible extensions 32 with spherically enlarged tips 34 thereon. The support arms 28 are bracked by diagonal rod braces 36 extending between the standards 14 and the arms 28. The braces 36 are in turn integrally formed with one of the cross bars 16 of the support wall 12.

A pair of opposed side arms 38 are provided parallel to the upper support arms 28 and vertically between the upper support arms 28 and the base 20. These side arms 38 are of a length substantially equal to that of the support arms 28 and of a horizontally elongate loop configuration with upper end lower parallel bars 40. For rigidity, the inner ends of the side arm rods 40 can be integral with selected ones of the cross bars 16 of the support wall 12.

Each of the side arms 38 includes a vertical plate 42 between the upper and lower rods thereof with a bag-retaining loop hook 44 welded to the upper rod 40 and depending, at a downward ad outwardly inclined angle, immediately outward of the corresponding vertical plate 42. These side hooks 44 define retainers for small T-shirt plastic grocery bags which would not be properly accommodated on the upper support arms provided primarily for full size grocery bags.

Storage of the full size bags prior to dispensing is facilitated by a single upwardly directed loop hook 46 welded to the uppermost cross bars 16 centrally between the upper support arms 28. This loop hook 46 extends sufficiently above the uppermost cross bar 16 to receive the mounting tabs of a full pack of bags thereon in a manner known in the art.

A pair of vertically spaced merchandise trays 48 extends outwradly from the vertical support wall 12 to the opposite side thereof relative to the base 20 and support arms 28. The trays 48, depending on the nature of the goods to be displayed therein and dispensed therefrom, can be constructed in a variety of manners. As illustrated, the trays are of open wire framework with vertical peripheral walls and front--to-rear partition bars 50.

The rear walls of the tray 48 are rigidly interconnected, as by welding, to a pair of laterally spaced standards 52 of a vertical rear support or support member 54. The standards 52 are interconnected by an integral transverse bar 56 between the upper ends thereof. The vertical standards 52 are in turn welded to the central portion of a pair of upper and lower stand-off brackets 58. The opposed end portions 60 of each of the brackets 58 are laterally offset and welded or otherwise permanently secured to the vertical support wall 12, more particularly the vertical standards 14 and, depending upon the position thereof, a cross bar 16. Thus mounted, the vertical support 54 is spaced from the support wall 12 which conveniently allows access to the rear of the trays 48, even with the rack fully loaded with bags.

The opposed sides of the vertically spaced trays 48 are interconnected by vertical side legs 62 defined by parallel space uprights 64 interconnected by an integral transverse bar 66 generally coextensive with the upper edge of the corresponding side wall of the upper tray 48.

The trays 48 preferably incline upward and outward relative to the vertical support 54 at a minor angle to the horizontal, for example 3° for the lower tray and 5° for the upper tray for a convenient stacking of goods therein and to define a slightly divergent space between the trays for access to the lower tray.

Figure 4:
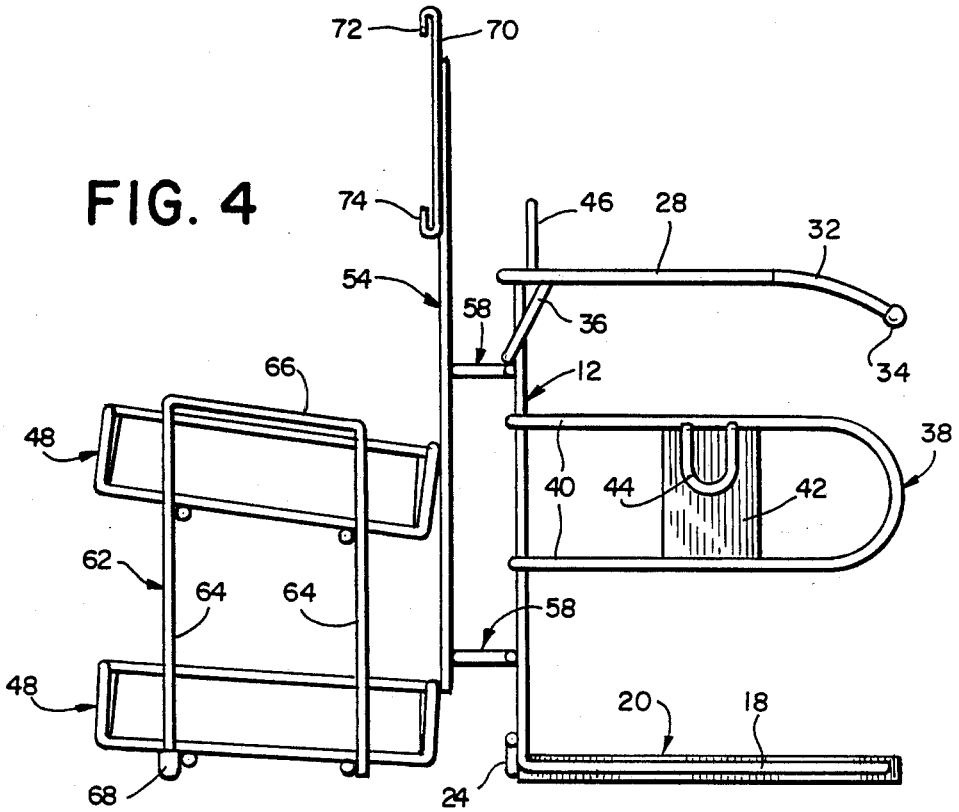
FIG. 4 is a side elevational view of the merchandising rack.

As will be appreciated from FIG. 4 in particular, the outermost side leg uprights 64 are of greater length than the corresponding inner uprights and are provided with elastomeric cushioning tips 68 which defines support feet. The support feet 68 in turn cooperate with the planar base 20 in providing for a stable support for the rack 10. As desired, the lower ends of the rear uprights 64 of the side legs 62 can either terminate above the plane of an underlying support surface, for example countertop, or alternatively, can also define support feet with or without cushioning tips.

The merchandising rack 10, as a self-contained unit, incorporates a display panel 70 transversely across the upper portion of the vertical support 54. The panel 70 is preferably of sheet metal and directly welded to the support uprights 52. The forward face of the display panel 70, that is the face directed toward the trays 48, includes inwardly turned upper and lower edges 72 and 74 which slidably receive appropriate information providing cards, for example naming the goods and the prices thereof.

The lower turned edge 74 is specifically spaced above the upper edge of the vertical support wall 12 and defines a central handgrip with the rack approximately balanced thereabout. The lateral space between the vertical support wall 12 and the vertical tray support 54 contributes to providing sufficient room for engagement of the fingers about the lower edge 74 for a single-handed carrying of the entire rack, even when loaded. It will be appreciated that the display panel 70 is of sufficient rigidity, particularly along the turned lower edge 74 thereof, to define a positive grip. While the merchandising rack 10 is preferably provided with the combination display panel and handle 70, in the absence of this panel 70, the transverse bar 56 of the vertical support 54 will also define a handle for the rack.

The merchandising rack 10 of the invention, as illustrated and described, mounts, displays and dispenses both goods to be sold to consumers and bags within which purchased goods are to be packaged. The rack is a self-contained unit specifically adapted to be mounted directly on the checkout counter of a grocery store or the like, and is portable so as to be readily carried from one counter to another, either empty or with goods and bags mounted therein.

The foregoing is considered illustrative of the principals of the invention. As modifications and variations in construction may occur, it is not desired to limit the invention to the exact construction shown and described.

I claim:

1. A merchandising rack for the storage and dispensing of merchandise and bags, said rack including a central vertical support wall having opposed first and second sides, a horizontal base rigid with said wall and projecting outward relative to said first side, bag support means rigid with said wall and projecting outward relative to said first side in vertically spaced relation over said base, and merchandise display means mounted on and projecting outward relative to the second side of the vertical support wall and in an opposed direction from said base relative to said vertical support wall, said bag support means comprising a pair of laterally spaced parallel arms engageable with selected portions of a bag for suspension of the bag therefrom said merchandise display means comprising at least one mechandise tray, a vertical support member paralleling said vertical support wall, means fixing said vertical support member to said support wall adjacent the second side thereof, said tray being fixed to said vertical support member.

2. The merchandising rack of claim 1 including multiple trays in vertically spaced relation to each other, each of said trays being fixed to said vertical support member.

3. The merchandising rack of claim 2 wherein said means fixing said vertical support member to said support wall maintains said vertical support member in spaced relation to the second side of the support wall.

4. The merchandising rack of claim 3 wherein said trays incline upward and outward relative to the second side of the support wall and at an angle to the horizontal, the lowermost tray extending at a lesser angle to the horizontal than the remaining tray or trays.

5. The merchandising rack of claim 3 including vertical side legs fixed to said trays in outwardly spaced relation to the vertical support member, said side legs depending below the lowermost tray for engagement with a support surface.

6. The merchandising rack of claim 5 wherein said vertical support member comprises a pair of standards extending vertically above said vertical support wall, and a transverse member rigid with and extending transversely between said standards in vertically spaced relation above said support wall.

7. The merchandising rack of claim 6 wherein said transverse member comprises an information display panel.

8. The merchandising rack of claim 2 wherein said vertical support member comprises a pair of standards extending vertically above said vertical support wall, and a transverse member rigid with and extending transversely between said standards in vertically spaced relation above said support wall.

9. The merchandising rack of claim 8 wherein said transverse member comprises an information display panel.

10. A merchandising rack for the storage and dispensing of merchandise and bags, said rack including a central vertical support wall having opposed first and second sides, a horizontal base rigid with said wall and projecting outward relative to said first side, bag support means rigid with said wall and projecting outward relative to said first side in vertically spaced relation over said base, and merchandise display means mounted on and projecting outward relative to the second side of the vertical support wall and in an opposed direction from said base relative to said vertical support wall, said bag support means comprising a pair of laterally spaced parallel arms engageable with selected portions of a bag for suspension of the bag therefrom, said merchandise display means comprising at least one merchandise tray, and means for fixing said merchandise tray to said support wall adjacent and in outwardly projecting relation to the second side thereof.

11. The merchandising rack of claim 10 including multiple merchandise trays fixed to said support wall in generally parallel vertically spaced relation to each other.

* * * * *